US007648216B2

(12) United States Patent
See Toh et al.

(10) Patent No.: US 7,648,216 B2
(45) Date of Patent: Jan. 19, 2010

(54) METHOD FOR PRINTING ON A PRINT MEDIA

(75) Inventors: Chee-Wah See Toh, Singapore (SG); Kok-Foo Chee, Singapore (SG); Pock-Chueng Teo, Singapore (SG); Wei-Chun Lim, Singapore (SG); Jun Lei, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 332 days.

(21) Appl. No.: 11/512,957

(22) Filed: Aug. 30, 2006

(65) Prior Publication Data

US 2008/0055352 A1 Mar. 6, 2008

(51) Int. Cl.

| | |
|---|---|
| ***B41J 29/38*** | (2006.01) |
| ***B41J 29/393*** | (2006.01) |
| ***B41J 2/01*** | (2006.01) |
| ***G06F 15/00*** | (2006.01) |

(52) U.S. Cl. ..... 347/16; 347/19; 347/104; 358/1.9

(58) Field of Classification Search ..... 347/16, 347/19, 104; 358/1.9

See application file for complete search history.

(56) References Cited

U.S. PATENT DOCUMENTS

| | | | | |
|---|---|---|---|---|
| 6,137,592 | A | 10/2000 | Arquilevich et al. | |
| 6,179,289 | B1 | 1/2001 | Matsushita et al. | |
| 6,425,699 | B1 | 7/2002 | Doval et al. | |
| 6,454,474 | B1 | 9/2002 | Lesniak et al. | |
| 6,612,685 | B1 | 9/2003 | Marra, III et al. | |
| 6,752,494 | B2 | 6/2004 | Matsui | |
| 6,808,247 | B2 | 10/2004 | Kawatoko et al. | |
| 6,871,934 | B2 | 3/2005 | Masuyama et al. | |
| 6,940,618 | B2 | 9/2005 | Kinas | |
| 6,942,406 | B2 | 9/2005 | Sunada et al. | |
| 6,984,082 | B2 | 1/2006 | Endo | |
| 2002/0063871 | A1 | 5/2002 | Kinas | |
| 2002/0101469 | A1 | 8/2002 | Wade et al. | |
| 2002/0126171 | A1 | 9/2002 | Subirada et al. | |
| 2004/0135836 | A1 | 7/2004 | Nunokawa | |
| 2004/0150686 | A1 | 8/2004 | Lee | |
| 2004/0156666 | A1 | 8/2004 | Ouchi et al. | |
| 2005/0078139 | A1 | 4/2005 | Kang et al. | |
| 2005/0122375 | A1 | 6/2005 | Otsuki | |
| 2005/0179758 | A1 | 8/2005 | Campillo et al. | |
| 2005/0206682 | A1 | 9/2005 | Togashi et al. | |
| 2005/0231745 | A1 | 10/2005 | Kawai et al. | |
| 2005/0248606 | A1 * | 11/2005 | Hoshiyama et al. | 347/19 |
| 2006/0044574 | A1 | 3/2006 | Ide et al. | |
| 2006/0066651 | A1 | 3/2006 | Linvillet et al. | |
| 2006/0066669 | A1 | 3/2006 | Bates et al. | |
| 2006/0066700 | A1 | 3/2006 | Simpson | |
| 2007/0121130 | A1 * | 5/2007 | Yoshida | 358/1.9 |

* cited by examiner

*Primary Examiner*—Matthew Luu
*Assistant Examiner*—Jannelle M Lebron

(57) ABSTRACT

In a method for printing on a print media using nozzles in a printhead, it is determined as to whether one or more of the nozzles are out. In response to the one or more of the nozzles being out, the print media is micro-linefed between at least two printing passes of the printhead when the printhead is substantially in position to print onto a margin section of the print media. The micro-linefeeding includes activation of a print media feed means to advance the print media for a distance that is substantially smaller than a normal advance of the print media, to thereby reduce printing defects in the margin section caused by one or more nozzles that are out.

18 Claims, 9 Drawing Sheets

METHOD FOR PRINTING ON A PRINT MEDIA

BACKGROUND

A conventional printer includes a reciprocating carriage for holding print cartridges in respective receptacles. The carriage is typically scanned across the width of a media and ink is ejected from the print cartridges in a controlled manner to form a swath of an image during each scan. The height of the printed swath (as measured in the direction the media is advanced) is fixed for a particular printhead. In addition, a mechanism for feeding the media is used to incrementally advance the media through a print zone between scans.

When printing such that the media contains no borders, conventional printers typically fire ink out of the printhead nozzles slightly beyond the end of the media. This generally ensures that, there are no blank areas around the bottom of the media. This extra printing requires an ink collection system in the platen to absorb the ink so that it does not mark subsequent sheets of media.

BRIEF DESCRIPTION OF THE DRAWINGS

Features of the present invention will become apparent to those skilled in the art from the following description with reference to the figures, in which.

DETAILED DESCRIPTION OF THE INVENTION

For simplicity and illustrative purposes, the present invention is described by referring mainly to an exemplary embodiment thereof. In the following description, numerous specific details are set forth in order to provide a thorough understanding of the present invention. It will be apparent however, to one of ordinary skill in the art, that the present invention may be practiced without limitation to these specific details. In other instances, well known methods and structures have not been described in detail so as not to unnecessarily obscure the present invention.

Disclosed herein are methods and systems for printing onto a print media. More particularly, the methods and systems disclosed herein substantially reduce or eliminate printing defects in a margin section of the print media caused by nozzles that are out. In one example, the printing defects may substantially be reduced through micro-linefeeding of the print media between passes of a printhead during printing onto the margin section. In another example, the printing defects may be reduced further or substantially eliminated through performance of a nozzle substitution operation in conjunction with the micro-linefeeding operation.

Figure 1A:
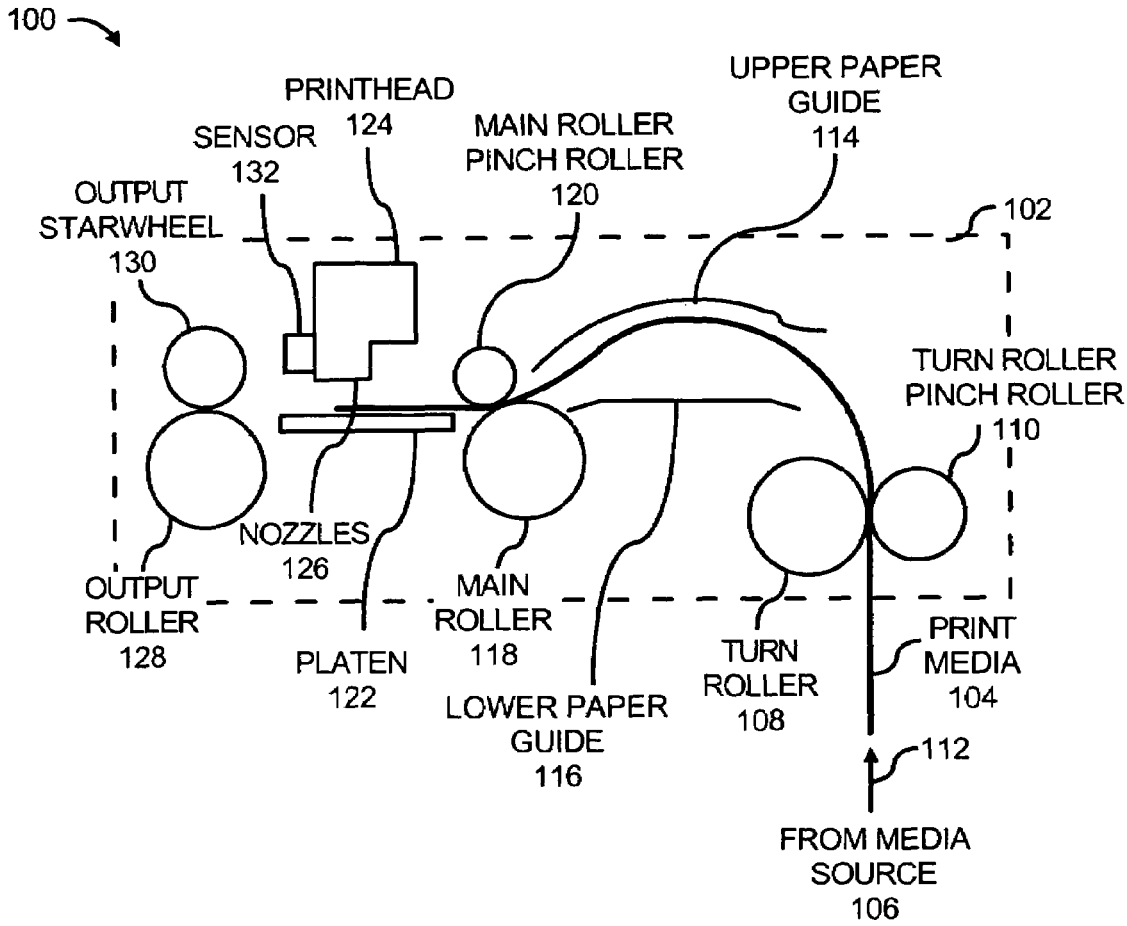
FIG. 1A shows a simplified schematic illustration of part of an image forming apparatus which may be employed to implement various examples of the invention, according to an embodiment of the invention.

With reference first to FIG. 1A, there is shown a simplified schematic illustration of part of an image forming apparatus 100 which may be employed to implement various examples of the invention. It should be readily apparent that the image forming apparatus 100 depicted in FIG. 1A represents a generalized illustration and that other components may be added or existing components may be removed or modified without departing from a scope of the image forming apparatus 100. For example, the image forming apparatus 100 may include any number of other components known to be included as a part of conventional image forming apparatuses.

Shown in FIG. 1A is a media feed apparatus 102 of the image forming apparatus 100. The media feed apparatus 102 may also include additional components and some of the components shown in the media feed apparatus 102 may be removed or modified without departing from a scope of the media feed apparatus 102. In addition, the media feed apparatus 102 may comprise a print media feed means. In any regard, FIG. 1A depicts a print media 104, such as, paper, photopaper, vellum, or another type material, being fed from a media source 106, such as, a tray configured to support a plurality of print media 104 sheets, a location for manually feeding of the print media 104 sheets, etc.

The print media 104 is depicted as entering into the media feed apparatus 102 through operation of a turn roller 108. More particularly, the print media 104 is pinched between the turn roller 108 and a turn roller pinch roller 110. Rotation of the turn roller 108, in a counter-clockwise direction, generally causes the print media 104 to be fed into the media feed apparatus 102 as indicated by the arrow 112. In addition, the print media 104 is fed between an upper paper guide 114 and a lower paper guide 116 of the media feed apparatus 102.

A portion of the print media 104 is also illustrated as being pinched between a main roller 118 and a main roller pinch roller 120. In addition, the print media 104 may be fed over a platen 122 and one or more printheads 124 (only a single printhead 124 is shown in FIG. 1A and discussed herein for purposes of simplicity) may deposit ink through a plurality of nozzles 126 onto the print media 104 to thereby form a desired image on the print media 104. Although not shown, the platen 122 may be formed of ribs and one or more ink absorbing material sections may be positioned between the platen 122 ribs to collect ink fired beyond the top or bottom of the print medial 104 without departing from a scope of the image forming apparatus 100.

As is generally known with inkjet printers, the printhead 124 may include one or more reservoirs containing ink of various colors, such as, cyan, magenta, yellow, black, etc., and nozzles 126 through which the ink is ejected and deposited onto the print media 104. In addition, the printhead 124 may be positioned on a movable carriage (not shown) configured to scan across the print media 104, thereby enabling ink to be deposited across the width of the print media 104. More particularly, the printhead 124 may be traversed into and out of the plane of FIG. 1A in successive printing passes and the print media 104 may be advanced one swath height or less between the successive printing passes to thereby enable ink to be deposited onto desired locations of the print media 104. The swath height may, for instance, be equal to the height of the nozzles 126 (in the direction of the print media 104 advance).

In one example, a portion of a successive pass of the printhead 124 may overlap a portion of a previous pass to thereby enable performance of an error hiding operation. The error hiding operation may be performed to substantially reduce printing defects, such as, missing or misfired ink droplets, resulting from one or more nozzles 126 that are out. The nozzles 126 may be considered to be "out" when they are misfiring or are otherwise operating improperly.

In any regard, the error hiding operation may include a passive error hiding operation or an active error hiding operation. The passive error hiding operation includes diffusion of the printing defects caused by the nozzles 126 that are out by linefeed advancing. In other words, in the passive error hiding operation, because the print media 104 is advanced between successive passes of the printhead 124, the nozzles 126 that are out do not continually attempt to print along the same horizontal line (into the plane of FIG. 1A) on the print media 104 during successive printing passes. Instead, the nozzles 126 that are out may be positioned over different portions of the print media 104 during each successive scan, thereby reducing the appearance of the printing defects.

The active error hiding operation includes substituting the nozzles 126 that are out with one or more nozzles 126 that are known to be operating properly. More particularly, for instance, the nozzles 126 may be tested prior to being implemented to deposit ink onto the print media 104, to determine which, if any, of the nozzles 126 are out. The nozzles 126 may be tested through any reasonably suitable testing procedure, such as, for instance, printing a test pattern and detecting the test pattern with the sensor 132.

During printing operations, a printing mask may be employed to prevent certain nozzles 126, such as, the nozzles 126 determined to be out, from firing. Instead, one or more of the nozzles 126 known to be operating properly may be fired during one or more printhead 124 passes to drop ink on the locations which were originally designated for the nozzles 126 that have been determined to be out.

Figure 1B:
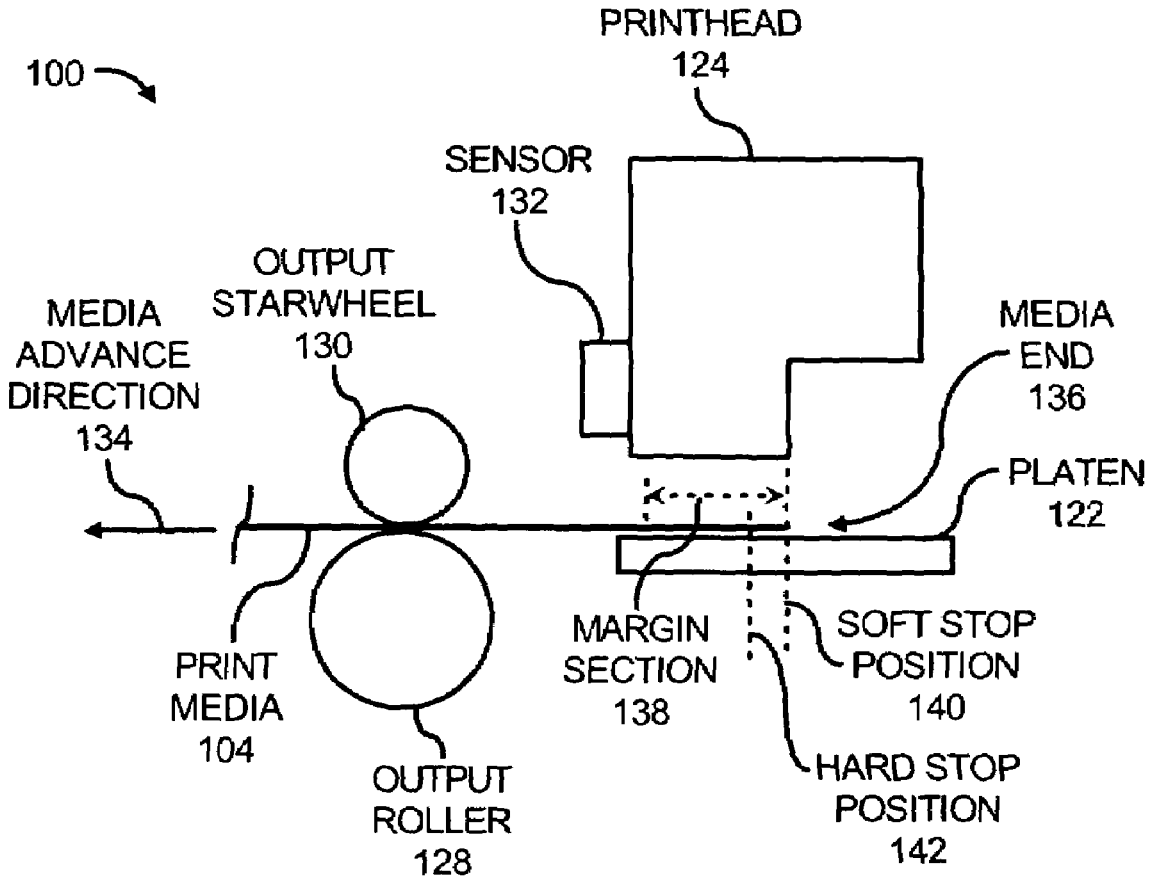
FIG. 1B shows an enlarged area of FIG. 1A where ink is deposited onto the print media from a printhead, according to an embodiment of the invention.

After the print media 104 has been advanced past the printhead 124, for instance, as shown in FIG. 1B, the print media 104 may continue to be advanced in the direction generally indicated by the arrow 134. The print media 104 may be advanced at this stage by operation of an output roller 128 and an output starwheel 130, as the main roller 118 and the main roller pinch roller 120 may have released the print media 104.

FIG. 1B, more particularly, depicts an enlarged area of FIG. 1A where ink is deposited onto the print media 104 from the printhead 124. As shown therein, the end 136 of the print media 104 is illustrated as being released from the main roller 118 and the main roller pinch roller 120. As such, the print media 104 may be advanced by rotation of the output roller 128 and the output starwheel 130.

Various sections of the print media 104 with respect to the printhead 124 are also depicted in FIG. 1B. For instance, adjacent the media end 136 is a margin section 138. The margin section 138 may be defined, for instance, as a portion of the print media 104 that typically remains unprinted. In this regard, for instance, the height of the margin section 138 may be user-definable or it may be set by the manufacturer of the image forming apparatus 100. In another example, the margin section 138 may be defined as the bottommost section of the print media 104 over which substantially all of the nozzles 126 are capable of depositing ink without causing an appreciable amount of ink from being deposited onto the platen 122.

Also shown in FIG. 1B are a soft stop position 140 and a hard stop position 142 of the print media 104. The soft stop position 140 may be defined as a placement of the print media 104 with respect to the printhead 124 where the nozzles 126 of the printhead 124 substantially covers the margin section 138, to thereby substantially prevent overspray on the platen 122. The hard stop position 140 may be defined as a placement of the print media 104 with respect to the printhead 124 where the end 136 of the print media 104 cannot be advanced further without causing overspray of ink on the platen 122.

As discussed in greater detail herein below, the print media 104 may be advanced in micro-linefeed distances and the printhead 124 may be scanned across the print media 104 for a number of passes when the print media 104 enters the soft stop position 140. The micro-linefeeding of the print media 104 and the scanning of the print media 104 may be performed for a number of passes or until the print media 104 reaches the hard stop position 142. In one regard, for instance, the printhead 124 may deposit ink onto the margin section while substantially reducing printing defects resulting from any nozzles 126 that are out.

Figure 2:
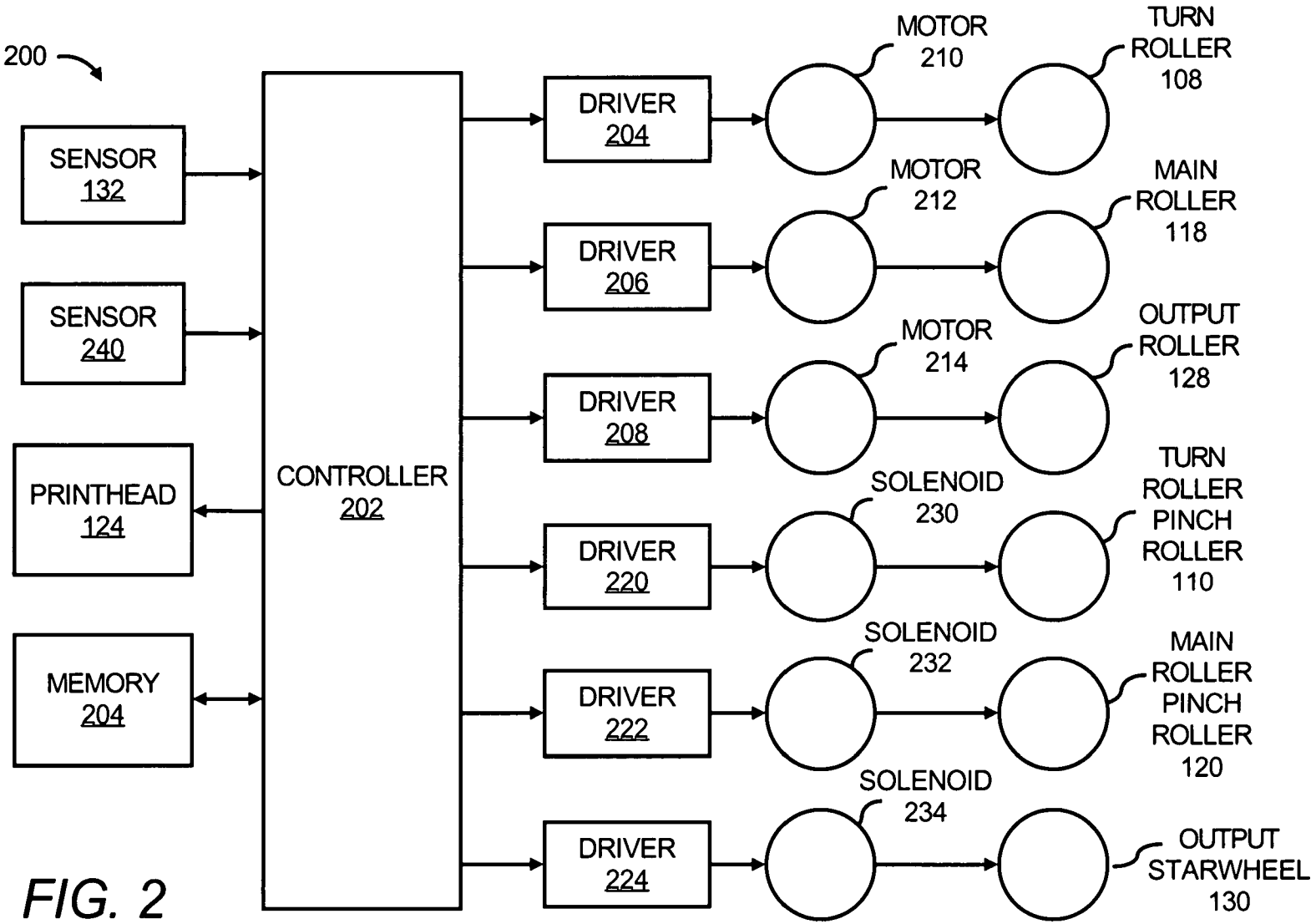
FIG. 2 is a block diagram of a control system for controlling components of the media feed apparatus depicted in FIGS. 1A and 1B, according to an embodiment of the invention.

FIG. 2 is a block diagram of a control system 200 for controlling components of the media feed apparatus 100, according to an example. It should be understood that the following description of the control system 200 is but one manner of a variety of different manners in which such a control system 200 may be configured. In addition, it should be understood that the control system 200 may include additional components and that some of the components described herein may be removed and/or modified without departing from a scope of the control system 200.

Generally speaking, the control system 200 may be implemented to at least control one or more operations of the media feed apparatus 102 and the printhead 124, to enable borderless printing while substantially reducing or eliminating the printing defects caused by nozzles 126 that are out. More particularly, for instance, the control system 200 may control the components of the media feed apparatus 102 such that print media 104 is advanced past the printhead 124 at a normal linefeed distance between printing passes until the margin section 138 becomes positioned to receive ink from the printhead 124 as shown in FIG. 1B.

At that instance, the control system 200 may control the components of the media feed apparatus 102 such that print media 104 is advanced past the printhead 124 at a micro-linefeed distance between printing passes for a predetermined number of passes or until the print media 104 reaches the hard stop position 142. Although not shown, the control system 200 may also control the carriage (not shown) on which the printhead 124 is supported.

As shown in FIG. 2, the control system 200 includes a controller 202 configured to perform various operations with regard to one or more of the components in the media feed apparatus 102. In this regard, the controller 202 may comprise a controlling means, such as, a microprocessor, a microcontroller, an application specific integrated circuit (ASIC), and the like, configured to perform various evaluation and control operations described herein.

The controller 202 is configured to send operating signals to motor drivers 204-208 to drive motors 210-214 respectively connected to the turn roller 108, the main roller 118, and the output roller 126. The drive motors 210-214 may also be respectively connected to one or more of the turn roller pinch roller 110, the main roller pinch roller 120, and the output starwheel 128, without departing from a scope of the control system 200. Generally speaking, the motor drivers 204-208 drive the motors 210-214 that turn the respective rollers 108, 118, 126. The controller 202 may also send operating signals to solenoid drivers 220-224 to drive solenoids 230-234 that selectively move the turn roller pinch roller 110, the main roller pinch roller 120, and the output starwheel 128 into or out of contact with respective ones of the turn roller 108, the main roller 118, and the output roller 126.

The controller 202 may therefore control rotation of the turn roller 108, the main roller 118, and the output roller 126, such that they feed the print media 104 at different linefeed distances between printing passes depending upon the position of the print media 104 relative to the printhead 124. More particularly, for instance, the controller 202 is configured to control the turn roller 108 and the main roller 118 to feed the print media 104 a normal distance between printing passes when the print media 104 is positioned to receive ink from the printhead 124. The controller 202 is also configured to control the output roller 128 to feed the print media 104 a micro-linefeed distance between printing passes when the margin section 128 of the print media 104 is positioned to receive ink from the printhead 124. The controller 202 may employ a sensor 240, positioned, for instance between the main roller 118 and the soft stop position 140, to detect the position of the print media 104. The sensor 240 may comprise an out of page sensor that may be triggered when the end 136 of the print media 104 passes through the sensor 240.

The controller 202 is further operable to control the printhead 124 to controllably place ink onto the print media 104. In one respect, the controller 202 may control the timing at which the nozzles 126 are fired to thereby deposit the ink in a substantially accurate manner. In another respect, the controller 202 may implement printing masks which may include schemes to control the nozzle 126 firing sequences. The printing masks may include, for instance, masks for actively hiding errors caused by nozzles 126 that are out.

In performing the above-described operations, the controller 202 may access a memory 204 that contains program code for the controller 202. The memory 204 may include non-volatile memory, such as one or more forms of ROM, one or more disk drives, RAM, other memory, or combinations of the foregoing. In some examples, the memory 204 stores program code or instructions, and the controller 202 fetches the instructions and outputs control instructions based on the execution of the fetched instructions to components of the image forming apparatus 100.

Some of the controller 202 operations are described in greater detail herein below with respect to the following flow diagrams.

Figure 3A:
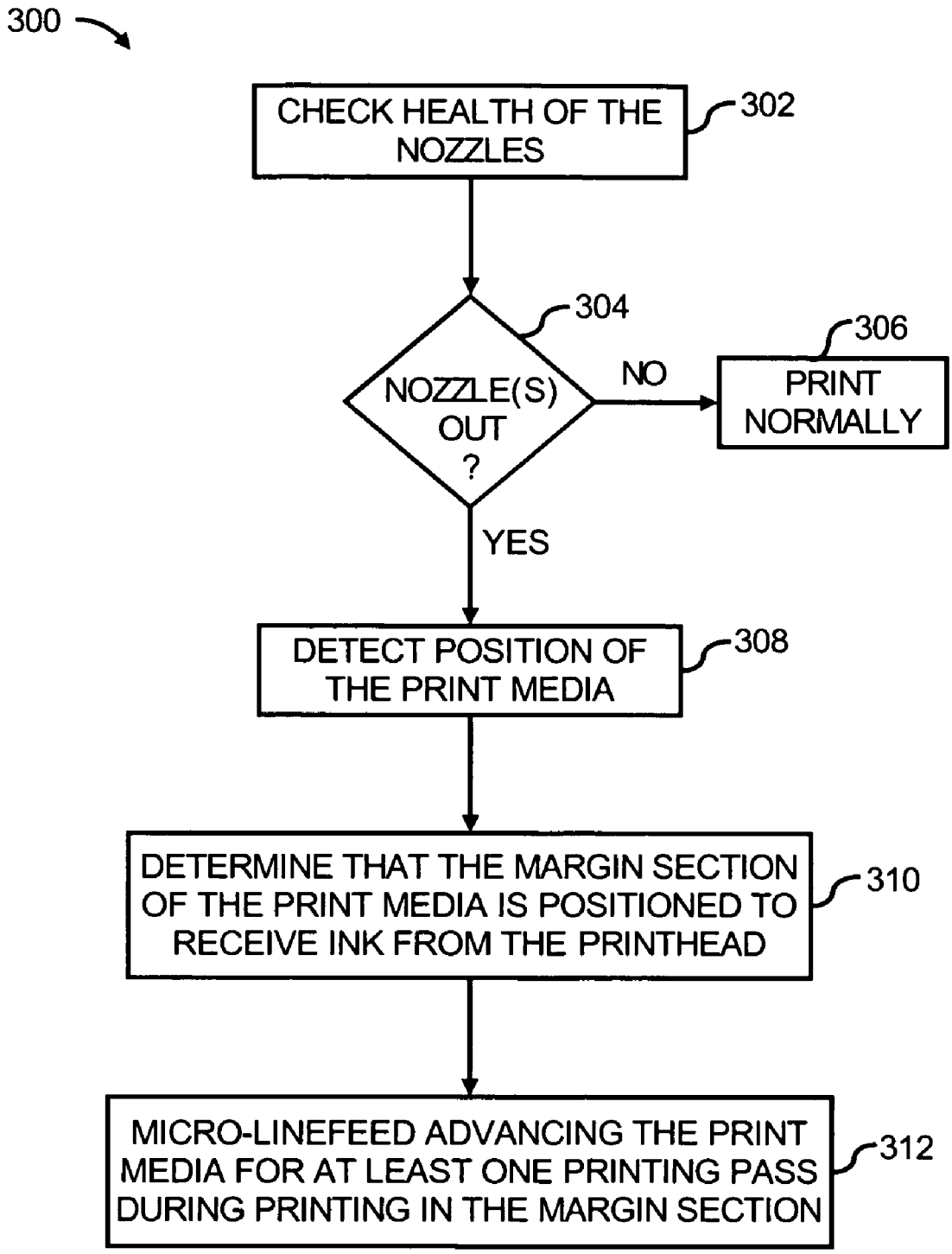
FIG. 3A illustrates a flow diagram of a method for printing on a print media using nozzles of a printhead, according to an embodiment of the invention.

With reference first to FIG. 3A, there is shown a flow diagram of a method 300 for printing on a print media 104 using nozzles 126 in a printhead 124, according to an example. It should be understood that the following description of the method 300 is but one manner of a variety of different manners in which an example of the invention may be practiced. It should also be apparent to those of ordinary skill in the art that the method 300 represents a generalized illustration and that other steps may be added or existing steps may be removed, modified or rearranged without departing from a scope of the method 300.

The description of the method 300 is made with reference to FIGS. 1A, 1B, and 2, and thus makes reference to the elements cited therein. It should, however, be understood that the method 300 is not limited to the elements set forth in FIGS. 1A, 1B, and 2. Instead, it should be understood that the method 300 may be practiced by an image forming apparatus and control system having different configurations than those set forth in FIGS. 1A, 1B, and 2.

Figure 4:
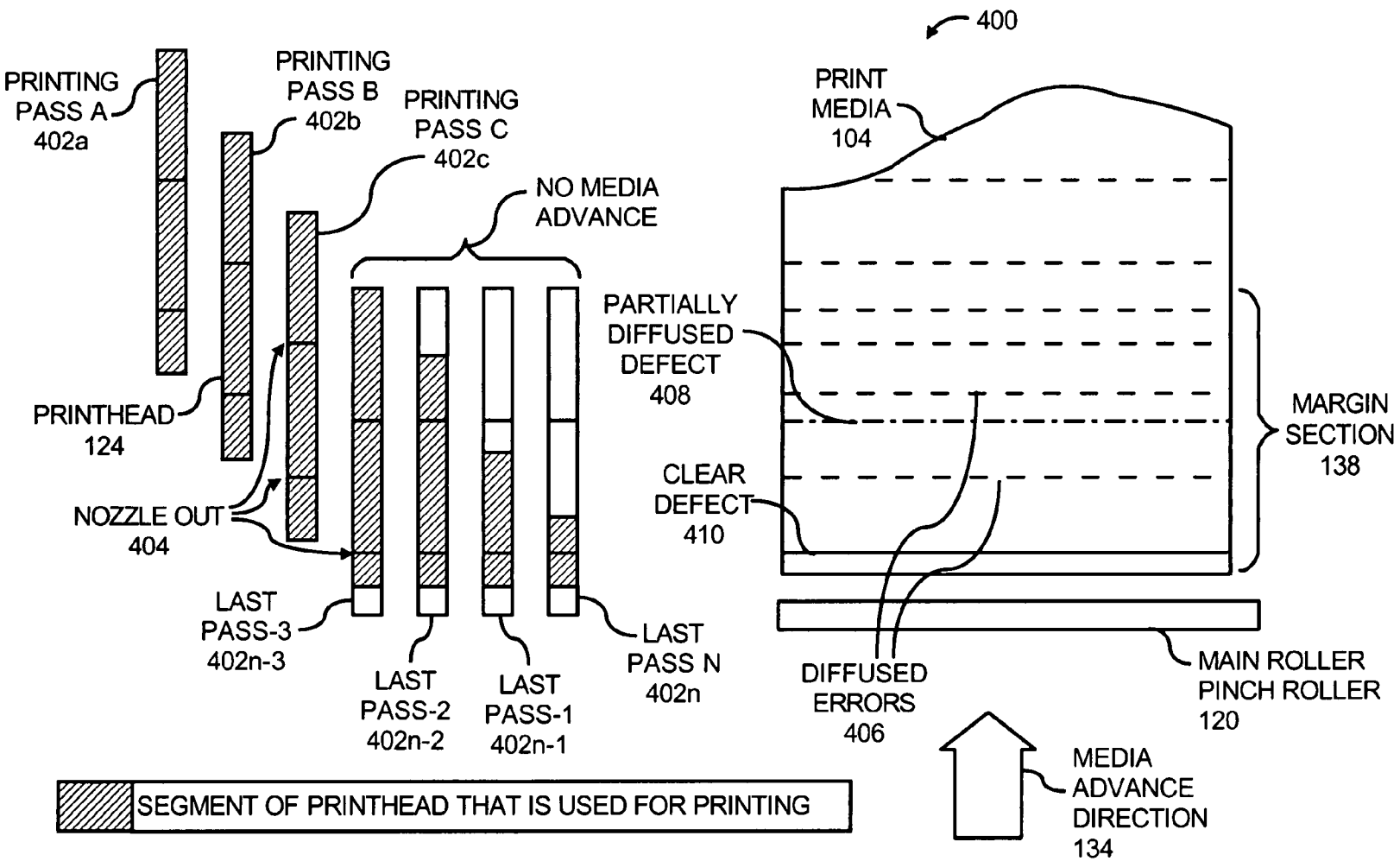
FIG. 4 (Prior Art)
FIG. 4 illustrates a diagram of a conventional manner in which a printhead may be operated to print onto a margin section of a print media.

Generally speaking, the method 300 may be implemented to substantially prevent or reduce defects in images printed onto the margin section 138 of a print media 104. Some of the defects caused by nozzles 126 that are out are depicted in FIG. 4, which illustrates a diagram 400 of a conventional manner in which a printhead 124 may be operated to print onto the margin section 138.

As shown therein, the print media 104 is depicted as being fed past the printhead 124 for a normal distance prior to the margin section 138 of the print media 104 being positioned to receive ink from the printhead 124. The normal distance is depicted in FIG. 4, for instance, as being the difference between the height of the printing pass A 402*a* and the height of the printing pass B 402*b*. Thus, for instance, in a four pass printing operation, the normal difference in height may be one-quarter of the height of the nozzles 126 in the printhead 124.

During each of the printing passes 402*a*-402*n*, some or all of the nozzles 126 may be used for printing. Those nozzles 126 that are used for printing are denoted by the shaded areas on the printhead 124. As shown, substantially all of the nozzles 126 may be employed for printing onto the print media 104 prior to reaching the hard stop position 142 (FIG. 1B). However, upon entering the hard stop position 142, fewer and fewer numbers of nozzles 126 may be employed to print onto the margin section 138 for successive printing passes.

The nozzles 126 that are out are depicted as lines 404 on the printhead 124. In addition, the printing defects caused by the nozzles 126 that are out 404 on the print media 104 are also shown in FIG. 4. More particularly, because the position of the printhead 124 relative to the print media 104 varies for each of the printing passes 402*a*-402*c* prior to reaching the soft stop position 140, the printing defects caused by the nozzles 126 that are out 404 are diffused, as indicated by the dashed lines 406. In addition, printing defects may be diffused to a lesser extent for those sections of the margin section 138 that are printed during at least two different printhead passes, as indicated, for instance, by the partially dashed line 408.

However, when the margin section 138 reaches the soft stop position 140 (FIG. 1B), in conventional systems, the print media 104 is not advanced further for the remaining printing passes. Instead, multiple printing passes 402*n*-3 to 402*n* are performed without advancing the print media 104. As such, the nozzles 126 that are out are used to print along the same location on the print media 104 and are thus prone to cause a clear printing defect 410 to be visible on the print media 104, as shown by the solid line in FIG. 4.

In order to substantially overcome this problem, an example of the invention as depicted in FIG. 3A, implements a micro-linefeed advance procedure when the print media 104 reaches the soft stop position 140 (FIG. 1B). More particularly, in the method 300, the controller 202 may check the health of the nozzles 126, as indicated at step 302. The controller 202 may perform any reasonably suitable check of the nozzles 126, such as, for instance, analyzing a printed test strip.

At step 304, the controller 202 may determine whether any of the nozzles 304 are out based upon the check performed at step 302. If the controller 202 determines that none of the nozzles 126 are out, or if the number of nozzles 126 that are out is below a predetermined threshold, the controller 202 may control the image forming apparatus 100 to operate normally as indicated at step 306. The predetermined threshold may be based upon, for instance, the level of quality desired in the printed image. Thus, for instance, the predetermined threshold may be relatively higher when a lesser quality image is desired. Alternatively, therefore, a relatively lower predetermined threshold may be employed when a relatively higher quality image is desired.

Thus, for instance, the controller 202 may control the components of the image forming apparatus 100 to print in the margin section 138 as described above with respect to FIG. 4 in situations where a relatively small number of nozzles 126 to no nozzles 126 are out. In other words, the controller 202 may control the image forming apparatus 100 to print in the margin section without advancing the printhead 124 between printing passes in those situations.

If, however, the controller 202 determines that one or more of the nozzles 126 are out, or that the number of nozzles 126 that are out exceeds the predetermined threshold, the controller 202 may detect the position of the print media 104 as indicated at step 308. The controller 202 may detect the position of the print media 104 through any reasonably suitable known means, such as, encoders, LEDs, etc. In addition, the controller 202 may detect that the print media 104 has reached the soft stop position 140 during step 308. In other words, the controller 202 may determine that the margin section 138 of the print media 104 is positioned to receive ink from the printhead 124, as indicated at step 310.

At step 312, the controller 104 may control one or both of the output roller 128 and the main roller 118 to micro-linefeed the print media 104 between subsequent printing passes. Micro-linefeed advancing of the print media 104 may be defined as advancing the print media 104 for a distance that is substantially smaller than a normal advance of the print media 104. By way of example only, for a printhead 124 having 1000 rows of nozzles 126, a micro-linefeed advance distance may comprise a distance equal to around 5-10 rows of nozzles 126.

In addition, or alternatively, the micro-linefeed advance distance may be selected to substantially strike a balance between a better diffusion of nozzles 126 when one or more of the nozzles 126 are out and better linefeed accuracy. More particularly, for instance, a larger micro-linefeed advancement distance may be used to get better diffusion of nozzles 126 and a smaller micro-linefeed advancement distance may be used to get a better linefeed accuracy.

Figure 5:
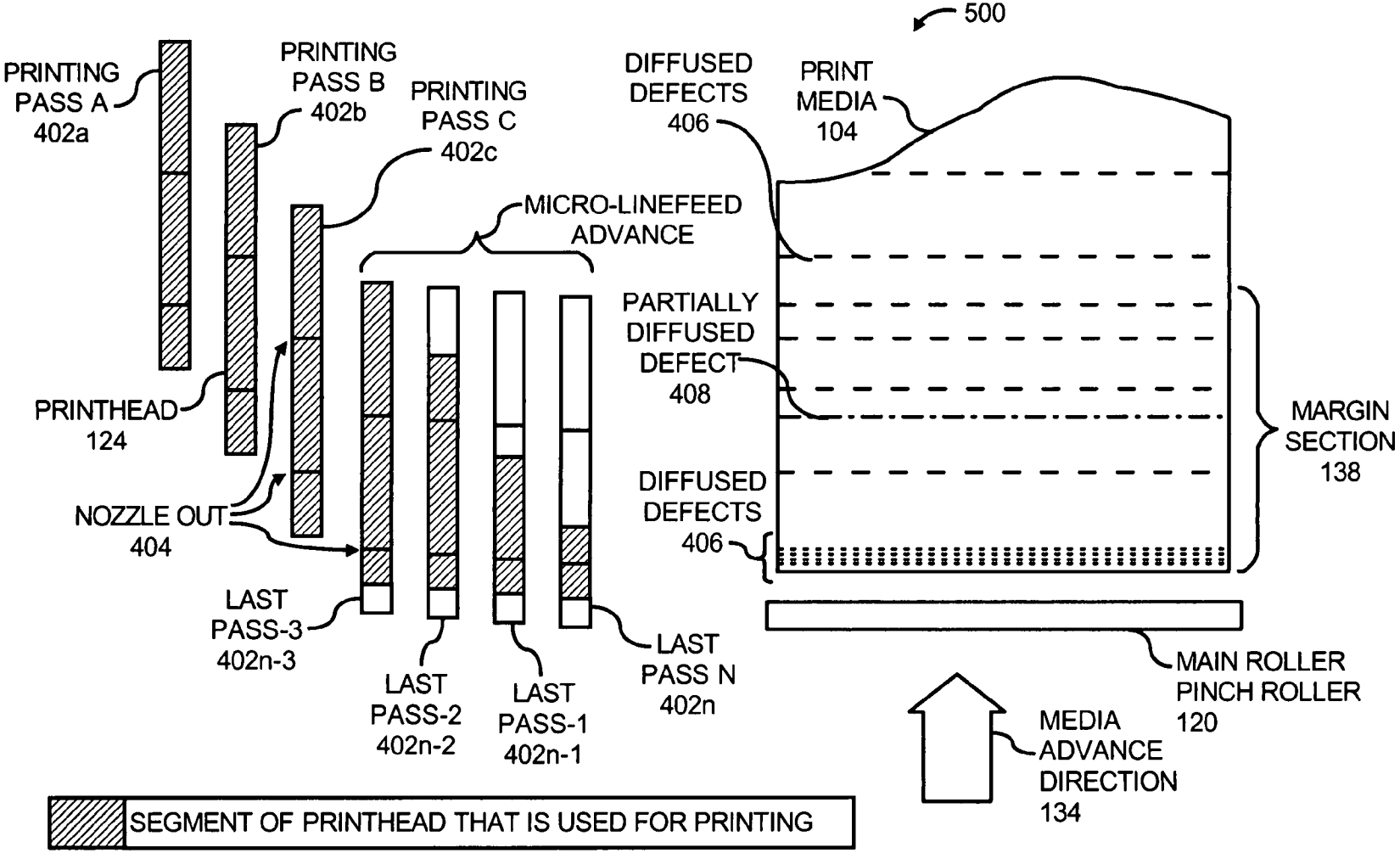
FIG. 5 illustrates a diagram of a manner in which a print media may be micro-linefeed advanced, according to an embodiment of the invention.

One manner in which the print media 104 may be micro-linefeed advanced is depicted in the diagram 500 of FIG. 5. As shown therein, once the margin section 138 is positioned to receive ink from the printhead 124, the print media 104 is micro-linefeed advanced between printing passes 402*n*-3 to 402*n*. By micro-linefeed advancing the print media 104 between printing passes 402*n*-3 to 402*n*, as shown in FIG. 5, the printing defects caused by the nozzles that are out 404 are substantially diffused as indicated by the dashed lines 406. As such, the printing defects caused by the nozzles that are out 404 may substantially be reduced.

Steps 302-308 are considered to be optional because the controller 202 may be configured to perform steps 310 and 312 for each borderless printing operation even in situations where none of the nozzles 126 or a relatively small number of nozzles 126 are out.

Figure 3B:
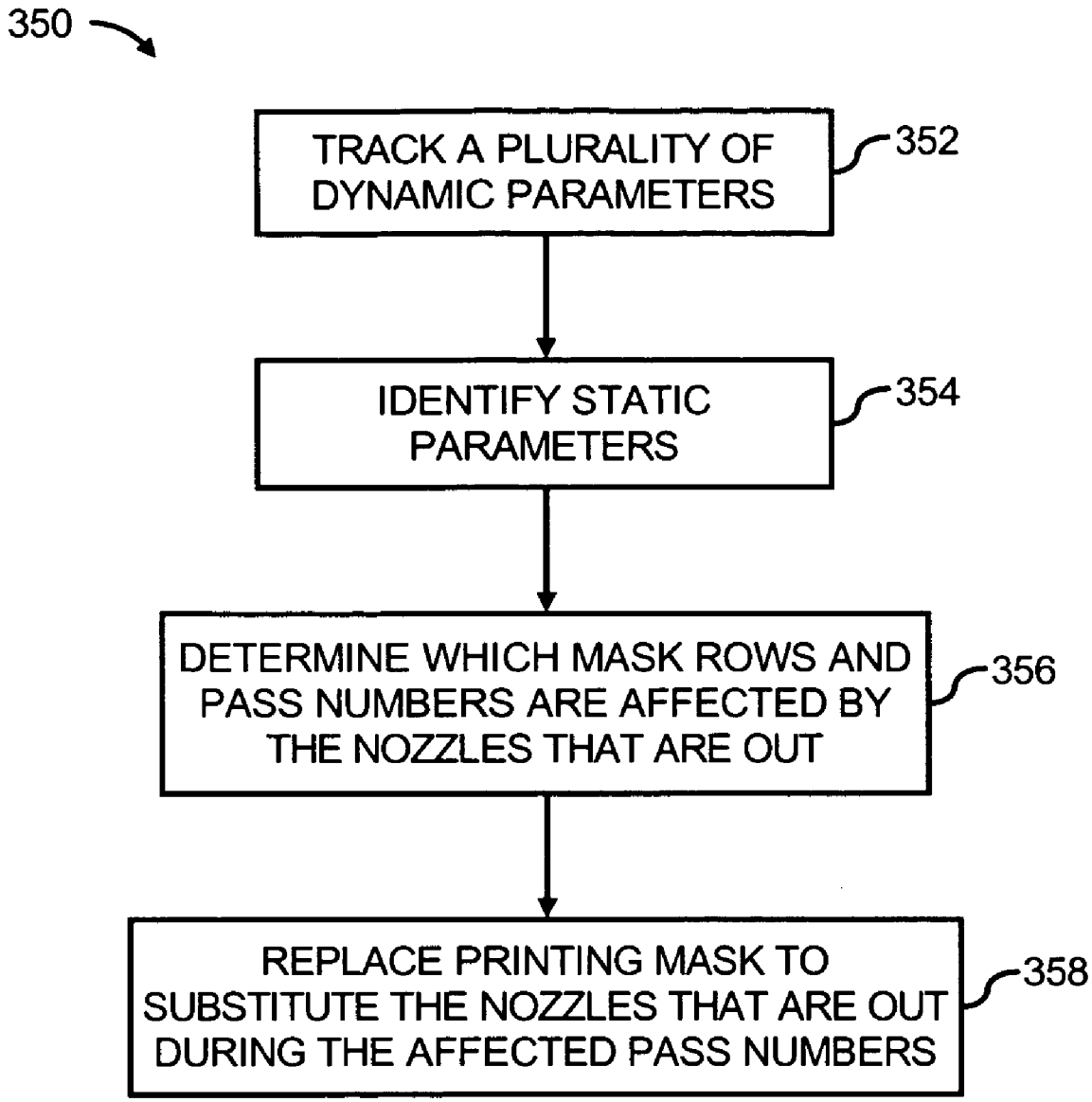
FIG. 3B illustrates a flow diagram of a method for performing a nozzle substitution operation which may be an optional enhancement operation to the method depicted in FIG. 3A, according to an embodiment of the invention.

According to another example, in addition to the method 300, the controller 202 may be programmed to perform a nozzle substitution operation for at least one printing pass 402*n*-3 to 402*n*, as shown in FIG. 3B. The nozzle substitution operation of the method 350 may substantially improve the hiding of the printing defects caused by the nozzles that are out 404, because those nozzles 126 may be substituted with nozzles 126 that are known to be functional.

FIG. 3B, more particularly, depicts a method 350 for substituting nozzles 126 that are out 404 according to an example of the invention. As such, the method 350 may be performed prior to, during, or both, performance of the printing passes 402*n*-3 to 402*n*. In addition, the method 350 may be considered as an optional enhancement operation to the method 300 because the printing defects may sufficiently be diffused through the micro-linefeed operation of the method 300 without having to perform the nozzle substitution operation of the method 350.

In any respect, if the controller 202 is programmed to perform the method 350, the controller 202 may track a plurality of dynamic parameters with respect to the print media 104 and the printhead 124, as indicated at step 352. The dynamic parameters may include, for instance, a soft stop shortage and a soft stop pass number. The soft stop shortage may be defined as a difference between a desired linefeed advance and the actual linefeed advance upon entering the soft stop position 140. The soft stop pass number may be defined as the pass number of the printhead 124 when the print media 104 enters the sot stop position 140.

At step 354, the controller 202 may be configured to identify a plurality of static parameters. The plurality of static parameters may include, for instance, the height of a printing mask, the micro-linefeed distance, and a mapping between the top of the printhead 124 and a mask row based upon the soft stop shortage 140, the soft stop pass number, the height of the mask, and the micro-linefeed distance.

At step 356, the controller 202 may determine which mask rows and pass numbers in the margin section 138 are affected by the nozzles that are out 404 based upon the mapping performed at step 354. In addition, at step 358, the controller 202 may replace a printing mask for those rows of nozzles 126 that are affected by the nozzles that are out 404 during the affected pass numbers 402*n*-3 to 402*n*.

At step 358, more particularly, the controller 202 may replace the printing mask by searching from the soft stop pass number for at least one nozzle 126 to replace at least one nozzle that is out 404. In addition, the controller 202 may identify those regions in the print media 104 that have already received ink prior to reaching the soft stop position as not needing replacement nozzles 126, even though those nozzles 126 may be out.

As such, through implementation of the methods 300 and 350, the diffused printing defects 406 (FIG. 5) may substantially be eliminated because ink may be deposited through use of functioning nozzles 126 instead of the nozzles that are out 404.

Figure 3C:
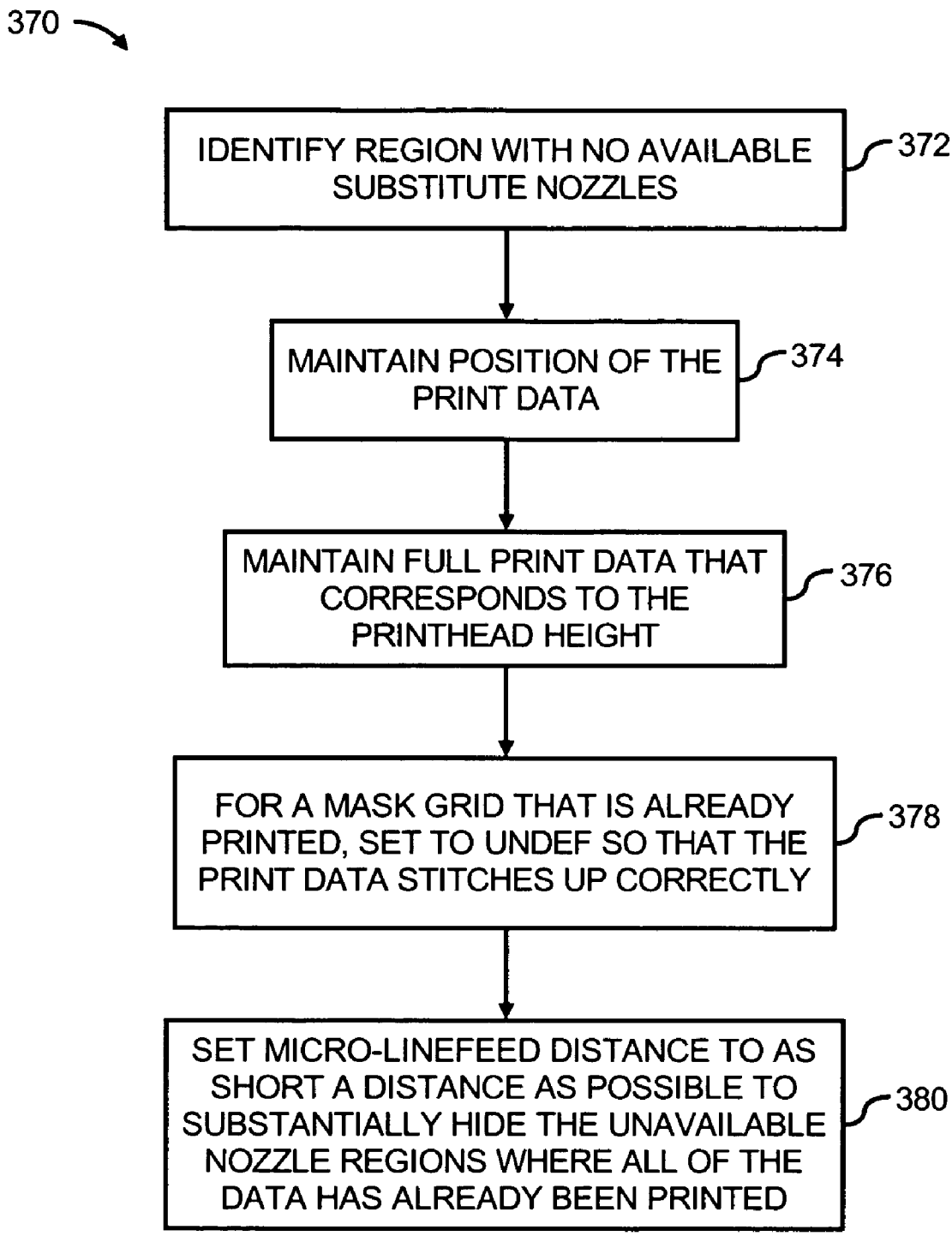
FIG. 3C illustrates a flow diagram of a method for performing a nozzle substitution operation which may be a further optional enhancement operation to the methods depicted in FIGS. 3A and 3B, according to an embodiment of the invention.

There may, however, arise situations where a suitable replacement nozzle 126 is not available for the printing regions of one or more of the nozzles that are out 404. These situations may arise, for instance, because the print data may be shifted downwards as shown between the last pass-3 402*n*-3 and the last pass-2 402*n*-2 (FIG. 5), the unshaded portion of the last pass-2 402*n*-2. In these situations, the controller 202 may implement a further enhancement method 370, as depicted in FIG. 3C. The method 370 may, for instance, be performed during the implementation of the method 350. In addition, the method 370 may be considered as an optional enhancement operation to the method 350.

In any regard, at step 372, the controller 202 may identify any printing regions that have no available substitute nozzles 126 for one or more of the nozzles 126 that are out 404. In response to the identification of at least one printing region at step 372, the controller 202 may control the image forming apparatus 100 to statically maintain the position of the print data, which includes data identifying the timing at which the nozzles 126 are fired, as indicated at step 374. The controller 202 may also maintain full print data that corresponds to the printhead 124 height, as indicated at step 376. At step 378, the controller 202 may set mask grids that have already been printed to undefined, which may control the printhead to cease firing ink regardless of the pass number, so that the print data stitches up correctly. In other words, the controller 202 may set the mask grids so that the transition area between previous passes before entering the margin section 138 receive ink. The controller 202 is further configured to set the micro-linefeed distance to as short a distance as reasonably possible to thereby substantially hide the unavailable nozzle 126 regions where all of the data has already been printed, as indicated at step 380.

Some or all of the operations set forth in the methods 300, 350, and 370 may be contained as a utility, program, or subprogram, in any desired computer accessible medium. In addition, some or all of the steps in the methods 300, 350, and 370 may be embodied by a computer program, which can exist in a variety of forms both active and inactive. For example, it can exist as software program(s) comprised of program instructions in source code, object code, executable code or other formats. Any of the above can be embodied on a computer readable medium, which include storage devices and signals, in compressed or uncompressed form.

Exemplary computer readable storage devices include conventional computer system RAM, ROM, EPROM, EEPROM, and magnetic or optical disks or tapes. Exemplary computer readable signals, whether modulated using a carrier or not, are signals that a computer system hosting or running the computer program can be configured to access, including signals downloaded through the Internet or other networks. Concrete examples of the foregoing include distribution of the programs on a CD ROM or via Internet download. In a sense, the Internet itself, as an abstract entity, is a computer readable medium. The same is true of computer networks in general. It is therefore to be understood that any electronic device capable of executing the above-described functions may perform those functions enumerated above.

Figure 6:
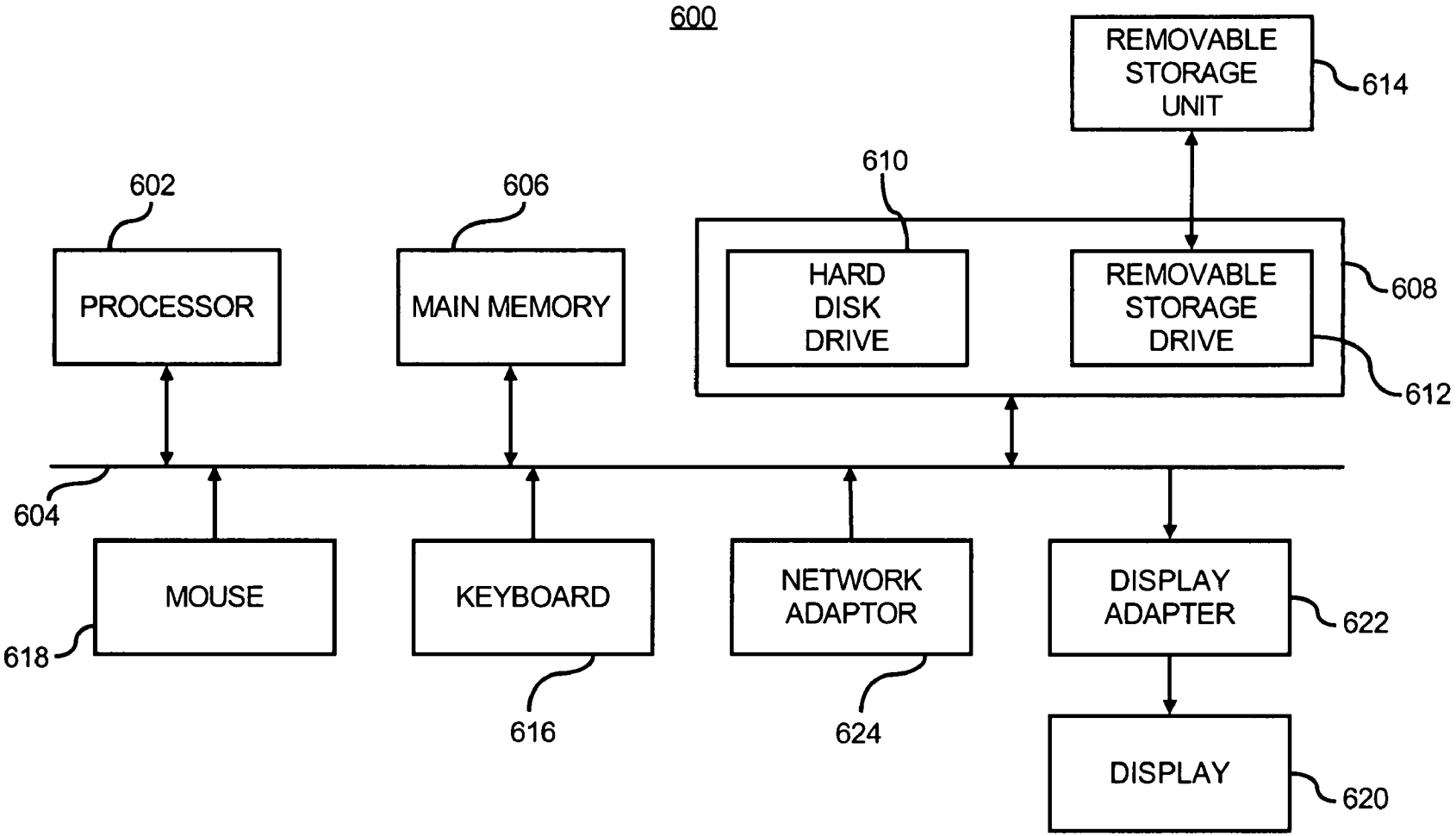
FIG. 6 illustrates a computer system, which may be employed to perform the various functions of the control system disclosed herein, according to an embodiment of the invention.

FIG. 6 illustrates a computer system 600, which may be employed to perform the various functions of the controller 202 described hereinabove, according to an embodiment. In this respect, the computer system 600 may be used as a platform for executing one or more of the functions described hereinabove with respect to the controller 202.

The computer system 600 includes one or more controllers, such as a processor 602. The processor 602 may be used to execute some or all of the steps described in the methods 300, 350, and 370. Commands and data from the processor 602 are communicated over a communication bus 604. The computer system 600 also includes a main memory 606, such as a random access memory (RAM), where the program code for, for instance, the controller 202, may be executed during runtime, and a secondary memory 608. The secondary memory 608 includes, for example, one or more hard disk drives 610 and/or a removable storage drive 612, representing a floppy diskette drive, a magnetic tape drive, a compact disk drive, etc., where a copy of the program code for the control system 200 may be stored.

The removable storage drive 610 reads from and/or writes to a removable storage unit 614 in a well-known manner. User input and output devices may include a keyboard 616, a mouse 618, and a display 620. A display adaptor 622 may interface with the communication bus 604 and the display 620 and may receive display data from the processor 602 and convert the display data into display commands for the display 620. In addition, the processor 602 may communicate over a network, for instance, the Internet, LAN, etc., through a network adaptor 624.

It will be apparent to one of ordinary skill in the art that other known electronic components may be added or substituted in the computer system 600. In addition, the computer system 600 may include a system board or blade used in a rack in a data center, a conventional "white box" server or computing device, etc. Also, one or more of the components in FIG. 6 may be optional (for instance, user input devices, secondary memory, etc.).

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims—and their equivalents—in which all terms are meant in their broadest reasonable sense unless otherwise indicated.

What is claimed is:

1. A method for printing on a print media using nozzles in a printhead, the print media having an end and a margin section adjacent the end, and wherein the printhead deposits ink onto the print media during successive printing passes, said method comprising:

determining whether one or more of the nozzles are operating improperly and determining how many of the one or more nozzles are operating improperly in response to a determination that one or more of the nozzles are operating improperly;

in response to at least a predetermined number of nozzles operating properly, feeding the print media at normal distances between the at least two printing passes of the printhead when the printhead is substantially in position to print onto the margin section; and in response to at least a predetermined number of nozzles operating improperly being-out, micro-linefeeding the print media between at least two printing passes of the printhead when the printhead is substantially in position to print onto the margin section, wherein micro-linefeeding the print media comprises activating a print media feed means to advance the print media for a distance that is substantially smaller than a normal advance of the print media, to thereby reduce printing defects in the margin section caused by one or more nozzles that are operating improperly.

2. The method according to claim 1, further comprising:

selecting a micro-linefeed distance for the print media advancement, wherein the micro-linefeed distance is selected to substantially strike a balance between a better diffusion of defects when one or more of the nozzles are operating improperly and better linefeed accuracy.

3. The method according to claim 1, further comprising:

performing a nozzle substitution operation for at least one pass of the printhead over the margin section.

4. The method according to claim 3, further comprising:

detecting if the print media is in a soft stop position, wherein said soft stop position comprises a placement of the print media with respect to the printhead where the nozzles of the printhead substantially covers the margin section, wherein the nozzle substitution operation further comprises tracking a soft stop shortage and a soft stop pass number, said soft stop shortage comprising a difference between a desired linefeed advance and an actual linefeed advance upon entering the soft stop position and the soft stop pass number comprising a pass number of the printhead upon entering the soft stop position.

5. The method according to claim 4, further comprising:

determining which of the nozzles are operating improperly; and wherein performing the nozzle substitution operation further comprises performing the nozzle substitution operation to substantially hide printing defects caused by the nozzles that are operating improperly by replacing the printing mask used by the printhead to print in the margin section.

6. The method according to claim 5, further comprising:

identifying the height of a printing mask;

identifying a micro-linefeed distance;

identifying a mapping between the top of the printhead and a mask row based upon the soft stop shortage, the soft stop pass number, the height of the mask, and the micro-linefeed distance; and determining which mask rows and pass numbers in the margin section are affected by the nozzles that are operating improperly based upon the mapping.

7. The method according to claim 6, further comprising:

identifying regions in the print media that have already been printed prior to reaching the soft stop position as not needing replacement nozzles.

8. The method according to claim 6, wherein replacing the mask further comprises initially searching from the soft stop pass number for at least one nozzle to replace at least one nozzle that is operating improperly.

9. The method according to claim 8, flutter comprising:

statically maintaining the position of print data used to identify the timing at which the nozzles are fired;

maintaining a full print data that corresponds to the height of the printhead;

setting mask grids that have already been printed such that they are not re-printed; and setting the micro-linefeed distance to as short a distance as reasonably possible to substantially hide the printing region having no substitute nozzles available.

10. An apparatus for forming an image onto a print media, said print media having a margin section adjacent an end of the print media, said apparatus comprising:

a print media feed means;

at least one printhead for supplying ink onto the print media; and a controller for controlling the print media feed means and the at least one printhead, wherein the controller is configured to determine whether one or more of the nozzles are operating improperly and determining how many or the one or mare nozzles are operating improperly in response to a determination that one or more of the nozzles are operating improperly, in response to at least a predetermined number of nozzles operating properly, feeding the print media at normal distances between the at least two printing passes of the printhead when the printhead is substantially in position to print onto the margin section, and in response to at least a predetermined number of nozzles operating improperly, the controller is configured to operate the print media feed means to advance the prim media a first linefeed distance between successive printing passes prior to the margin section being positioned to receive ink and to operate the print media feed means to advance the print media a second linefeed distance between successive printing passes to supply ink onto the margin section, wherein the second linefeed distance is substantially shorter than the first linefeed distance.

11. The apparatus according to claim 10, wherein the controller is configured to activate the print media feed means to advance the print media the second linefeed distance between successive printing passes to supply ink onto the margin section in response to the controller determining that a number of nozzles that are operating improperly exceeds a predetermined threshold, and wherein the controller is further configured to operate the print media feed means to advance the print media the first linefeed distance between successive printing passes to supply ink onto the margin section in response to a determination that the predetermined threshold is not exceeded.

12. The apparatus according to claim 11, wherein the controller is further configured to operate the at least one printhead to perform a nozzle substitution operation during printing onto the margin section.

13. The apparatus according to claim 12, wherein the controller is further configured to track a soft stop shortage and a soft stop pass number, said soft stop shortage comprising a difference between a desired linefeed advance and an actual linefeed advance upon entering a soft stop position and the soft stop pass number comprising a pass number of the printhead upon entering the soft stop position, and wherein the controller is further configured to identify a mapping between a top of the printhead and a printing mask row based upon the soft stop shortage and the soft stop pass number.

14. The apparatus according to claim 13, wherein the controller is further configured to determine which printing mask rows and pass numbers in the margin section are affected by the nozzles that are operating improperly based upon the mapping, and wherein the controller is further configured to substitute the nozzles that are operating improperly through use of a replacement printing mask, to thereby substantially hide printing defects caused by the nozzles that are operating improperly.

15. The apparatus according to claim 14, wherein the controller is further configured to initially search for at least one nozzle to replace at least one nozzle that is operating improperly from the soft stop pass number.

16. The apparatus according to claim 15, wherein the controller is further configured to statically maintain the position of print data used to identify the timing at which the nozzles are fired; to maintain a tall print data that corresponds to the height of the printhead; to set mask grids that have already been printed such that they are not re-printed, and to set the second linefeed distance to as short a distance as reasonably possible to substantially hide the printing region.

17. A computer readable storage medium on which is embedded one or more computer programs, said one or more computer programs implementing a method for printing on a print media using nozzles in a printhead, the print media having an end and a margin section adjacent the end, wherein the print media is advanced past the printhead by a print feed means, and wherein the printhead deposits ink onto the print media during successive passes, said one or more computer programs comprising a set of instructions for;

determining when a margin section of the print media is positioned to receive ink from the printhead;

determining whether one or more of the nozzles are operating improperly and determining how many of the one or more nozzles are operating improperly in response to a determination that one or more of the nozzles are operating improperly;

operating the print feed means to feed the print media at normal distances between at least two successive printing passes of the printhead when the printhead is substantially in position to print onto the margin section in response to at least a predetermined number of nozzles operating properly; and operating the print feed means to micro-linefeed the print media for at least one printing pass of the printhead over the margin section when it is determined that the printhead is substantially in position to print onto the margin section and in response to at least a predetermined number of nozzles operating improperly, wherein micro-linefeeding the print media comprises advancing the print media for a distance that is substantially smaller than a normal advance distance of the print media and to thereby reduce printing defects in the margin section caused by one or more nozzles that are operating improperly.

18. The computer readable medium according to claim 17, the set of instructions further comprising:

selecting one or more substitute nozzles to employ in place of the one or more nozzles that are out; and implementing a replacement printing mask to print onto the margin section with the one or more substitute nozzles.

* * * * *

UNITED STATES PATENT AND TRADEMARK OFFICE

CERTIFICATE OF CORRECTION

PATENT NO. : 7,648,216 B2
APPLICATION NO. : 11/512957
DATED : January 19, 2010
INVENTOR(S) : Chee-Wah See Toh et al.

It is certified that error appears in the above-identified patent and that said Letters Patent is hereby corrected as shown below:

In column 10, line 49, in Claim 1, after "improperly" delete "being-out".

In column 11, line 41, in Claim 9, delete "flutter" and insert -- further --, therefor.

In column 11, line 60, in Claim 10, delete "or" and insert -- of --, therefor.

In column 11, line 61, in Claim 10, delete "mare" and insert -- more --, therefor.

In column 12, line 4, in Claim 10, delete "prim" and insert -- print --, therefor.

In column 12, line 54, in Claim 16, delete "tall" and insert -- full --, therefor.

In column 12, line 67, in Claim 17, delete "for;" and insert -- for: --, therefor.

In column 14, lines 5-8, in Claim 17, delete "media and
to thereby reduce printing defects in the margin section caused by one or more
nozzles that are operating improperly." and
insert -- media to thereby reduce printing defects in the margin section caused by one or more nozzles that are operating improperly. --, therefor.

Signed and Sealed this

Fourth Day of May, 2010

David J. Kappos

David J. Kappos
*Director of the United States Patent and Trademark Office*